US007880679B2

(12) United States Patent
Kuehne

(10) Patent No.: US 7,880,679 B2
(45) Date of Patent: Feb. 1, 2011

(54) MULTIBAND ANTENNA SYSTEM

(75) Inventor: Rainer Kuehne, Hannover (DE)

(73) Assignee: Robert Bosch GmbH, Stuttgart (DE)

( * ) Notice: Subject to any disclaimer, the term of this patent is extended or adjusted under 35 U.S.C. 154(b) by 241 days.

(21) Appl. No.: 12/064,771

(22) PCT Filed: Jul. 24, 2006

(86) PCT No.: PCT/EP2006/064568

§ 371 (c)(1),
(2), (4) Date: Jun. 5, 2008

(87) PCT Pub. No.: WO2007/023054

PCT Pub. Date: Mar. 1, 2007

(65) Prior Publication Data

US 2009/0015492 A1 Jan. 15, 2009

(30) Foreign Application Priority Data

Aug. 24, 2005 (DE) ..... 10 2005 039 914

(51) Int. Cl.
*H01Q 1/02* (2006.01)
*H01Q 1/32* (2006.01)

(52) U.S. Cl. ..... 343/704; 343/711; 343/715

(58) Field of Classification Search ..... None
See application file for complete search history.

(56) References Cited

U.S. PATENT DOCUMENTS

| | | | | |
|---|---|---|---|---|
| 3,971,029 | A * | 7/1976 | Torii et al. | 343/704 |
| 4,914,446 | A | 4/1990 | Lindenmeier et al. | |
| 5,334,989 | A * | 8/1994 | Nagayama et al. | 343/713 |
| 5,461,391 | A * | 10/1995 | Ohnishi et al. | 343/713 |
| 5,654,720 | A * | 8/1997 | Saitou et al. | 343/713 |
| 5,877,727 | A | 3/1999 | Saitou et al. | |
| 5,933,119 | A | 8/1999 | Fujii et al. | |
| 6,198,447 | B1 | 3/2001 | Sauer | |
| 6,215,450 | B1 * | 4/2001 | Oka | 343/713 |
| 6,243,043 | B1 * | 6/2001 | Terashima et al. | 343/713 |
| 2004/0056810 | A1 | 3/2004 | Oka | |
| 2005/0030235 | A1 * | 2/2005 | Noguchi et al. | 343/713 |
| 2008/0055169 | A1 * | 3/2008 | Kuehne | 343/713 |

FOREIGN PATENT DOCUMENTS

| | | |
|---|---|---|
| DE | 39 10 031 | 10/1989 |
| DE | 42 37 818 | 5/1994 |
| DE | 197 26 420 | 12/1998 |
| EP | 0 269 723 | 6/1988 |
| EP | 0 559 196 | 9/1993 |
| WO | WO 99/66587 | 12/1999 |
| WO | WO 02/056412 | 7/2002 |

OTHER PUBLICATIONS

International Search Report, PCT International Patent Application No. PCT/EP2006/064568, dated Oct. 9, 2006.

* cited by examiner

*Primary Examiner*—Trinh V Dinh
(74) *Attorney, Agent, or Firm*—Kenyon & Kenyon LLP

(57) ABSTRACT

In a multiband antenna system for a vehicle windshield, an antenna conductor structure is provided in lateral recesses of the heating conductor field. The antenna conductor structure is non-electrically coupled to the heating conductor field with low resistance using high-frequency technology. This system ensures defrosting of the vehicle windshield in the entire wiped area without being affected by the antenna conductor structure.

15 Claims, 3 Drawing Sheets

MULTIBAND ANTENNA SYSTEM

RELATED APPLICATIONS

This application is a 371 of PCT/EP2006/064568 filed Jul. 24, 2006, which claims priority under 35 U.S.C. 119 to Germany Application 10 2005 039 914.2 filed on Aug. 24, 2005, the contents of which are incorporated herein by reference.

FIELD OF THE INVENTION

The present invention relates to an antenna system, in particular for a vehicle window pane/windshield, having a heating conductor field in particular in or on a vehicle window pane/windshield and an antenna conductor structure which is connected to the heating conductor field using high-frequency technology.

BACKGROUND INFORMATION

Such an antenna system is described in German Published Patent Application No. 39 10 031. PCT International Published Patent Application No. WO 02/056412, in which two antenna elements are provided for diversity analysis, shows a similar antenna system.

PCT International Published Patent Application No. WO 99/66587 shows an antenna system for diversity operation. The heating conductor field of a vehicle windshield is used, in combination with additional conductor structures not connected to the heating conductor field and located between the heating conductor field and the upper edge of the motor vehicle windshield as an antenna for receiving LMS, UHF, and optionally TV signals.

Antenna systems forming antennas for the LMS and UHF reception from the electrically contacted heating conductor field are known. Filter elements which decouple the vehicle electrical system are needed here for the UHF/TV and LMS reception because of the electrical connections between the antenna connecting point and the heating conductors (see, e.g., European Published Patent Application No. 0 269 723). The heating conductors extend substantially horizontally and substantially parallel to the metallic boundaries of the windshield. The electrical system interference transmitted from the heating current to the heating conductors used as antennas must, as known, be suppressed via modules that have a high resistance using high-frequency technology when the antenna connecting point is electrically connected to the heating conductor field. For UHF/TV reception, there are rod core inductors, which are integrated into the conductor portions supplying the heating current and are usually located in the proximity of the heating current terminals of the heating conductor field.

For LMS reception, this is a current-compensated toroidal core inductor (AM rejection circuit), which is also located in the heating current lead. This AM rejection circuit is a very cost-intensive module, whose own weight (approximately 200 g) results in excessive mechanical loads on both the circuit board and the screw attachment points and is therefore considered highly critical from the point of view of quality assurance. Vibrations occurring under normal driving conditions result in high stresses on the soldered points. In compact vehicles this AM rejection circuit is often installed in the rear trunk lid, so that when the lid is closed, accelerations of approximately 50 g may occur and the entire module may become detached from the screw attachment points.

Antenna systems in composite glass windshields, for example, front windshields of passenger cars, are also known.

In this case the antenna wires are located between the two glass panes, which results in increased complexity in contacting. Contacting may often be implemented using so-called flat conductors, which are installed in the composite safety glass pane during the production process. After installing the pane into the vehicle, this flat conductor is then connected to an electronic module.

SUMMARY OF THE INVENTION

The measures according to example embodiments of the present invention, i.e., a heating conductor field, in particular on or in a vehicle window pane/windshield having lateral recesses, an antenna conductor structure for at least two reception ranges outside the heating conductor field, which is substantially located in the lateral recesses of the heating conductor field, a non-electric low-resistance coupling of the antenna conductor structure to the heating conductor field using high-frequency technology, which is effective for one of the at least two reception ranges, the reception of LMS and diversity UHF/TV signals being able to be implemented in a single window pane, the area to be heated being as large as possible. In particular, the area which in the case of the rear window of a compact vehicle is wiped by the windshield wiper may be completely heated without being impaired by the antenna conductor structure because the latter is substantially located in a lateral area outside the heating conductor field which is not wiped by the windshield wiper. Window pane and windshield are used herein, where a windshield is only an exemplary embodiment of a window pane.

The system according to example embodiments of the present invention thus eliminates an important disadvantage of the above-mentioned antenna systems, namely the need for an area, for example, in the upper portion of the window pane, which cannot be heated and therefore cannot be defrosted because of the non-existent heating conductors. Especially in the case of passenger cars having small windows the resulting heatable surface is unacceptably small.

The multiband antenna structure according to example embodiments of the present invention has the specific advantage that the entire area that is wiped by a windshield wiper, or at least a substantial portion thereof, is heated. At the same time, a separate antenna conductor is available, which may be optimally designed for optimum reception without the antenna conductor and the heating field mutually influencing each other. For this purpose, the structure of the heating conductor is located in particular in the central area of the window pane. Due to the non-existence of electrical contact with the heating conductor field—the coupling is low-resistance, for example capacitive, using high-frequency technology—interference from the vehicle's electrical system, which is transmitted via the heating current, may have less influence on the antenna function, and filtering measures are easier and less expensive to implement or may possibly be entirely omitted.

Uniform defrosting of the window pane is ensured via the width of the conductor path of a portion of the heating conductor, i.e., via the resulting ohmic resistance of the heating conductor.

Exemplary embodiments of the present invention are described below in greater detail on the basis of the drawings.

DETAILED DESCRIPTION

Figure 1:
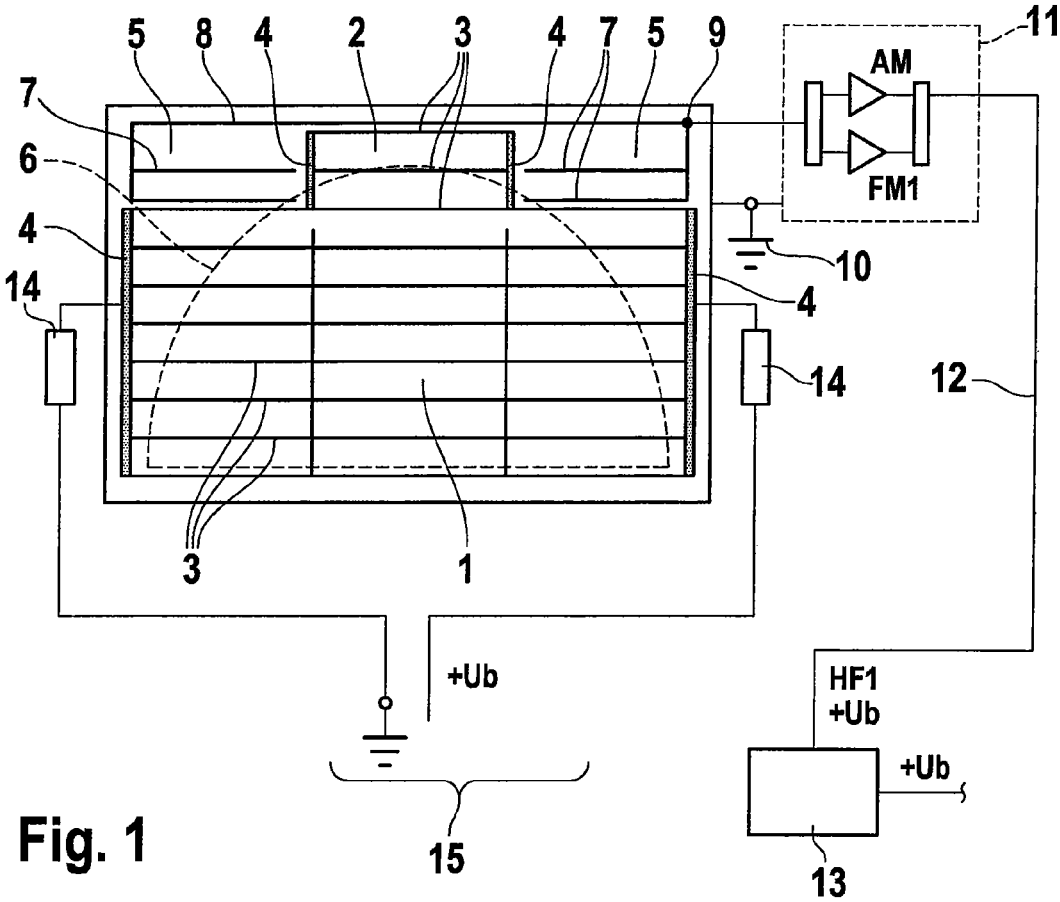
FIG. 1 shows a multiband antenna system according to an example embodiment of the present invention.

FIG. 1 shows a vehicle windshield antenna for multiband reception, in particular for LMS and UHF reception, for which the heating conductor field is also used. Heating conductors 3 are arranged parallel to each other. In a first segment 1, which fills the entire width of the vehicle windshield, their left-hand and right-hand ends terminate in a bus bar 4. In the upper area, the heating conductor field has a second segment 2, which does not extend over the entire width of the vehicle windshield, but only over the area which is wiped by the free windshield wiper end. Windshield area 6 wiped by the windshield wiper is shown as a dashed semicircle. The width of second segment 2, which also has two bus bars 4 and is connected in parallel to the outermost heating conductor of first segment 1 in the upper area, is adapted to the wiping area of the windshield wiper in such a way that the entire wiping area may be defrosted. Lateral recesses 5 of the vehicle windshield, which are formed by second segment 2 being provided only in a partial area of the width of the vehicle windshield, are used by antenna conductor structures 7 without impairment of windshield defrosting. Antenna conductor structure 7 shown in FIG. 1 has three parallel conductors in both left-hand and right-hand recesses 5. Antenna conductor 8 on the upper edge connects the antenna conductor structures in the left-hand and right-hand recesses. At one point, the individual parallel conductors of antenna conductor structure 7 are combined to form an antenna connecting point 9 in the area of the right-hand recess. The corresponding grounding point 10 is advantageously located in the immediate proximity on the metallic vehicle body surrounding the vehicle windshield. An antenna signal amplifier 11, separate for AM (LMS range) and FM, is located in the immediate proximity. The antenna signals are conducted to radio 13 via HF cable 12 connected thereto. Supply voltage $U_b$ to amplifier 11 may also be transmitted over the HF cable. Antenna connecting point 9 is electrically connected only to antenna conductor structure 7, but not to heating conductor field 1. The heating circuit has heating conductors of heating conductor field 1, bus bars 4, FM inductors 14, and heating current supply source 15.

The antenna conductor structure in FIG. 1 is designed in particular in such a way that a resonant response occurs in the UHF range. At the same time, it is as long as possible in order to ensure sufficient reception performance for the LMS (AM) range and to have optimum reception capacitance against ground. In this example embodiment, due to the proximity of at least one antenna conductor of the antenna conductor structure to heating field 1, there is also a low-resistance, in particular capacitive, coupling using high-frequency technology, so that virtually the entire heating conductor field is available as an effective antenna surface for UHF frequencies. Due to this low-resistance coupling to the heating conductor field in high-frequency technology, vehicle electrical system filter elements are again needed in this case. Further conductor parts may be installed into the windshield, which are essentially placed not for reception but mainly for visual reasons to generate a uniform visual appearance.

Figure 2:
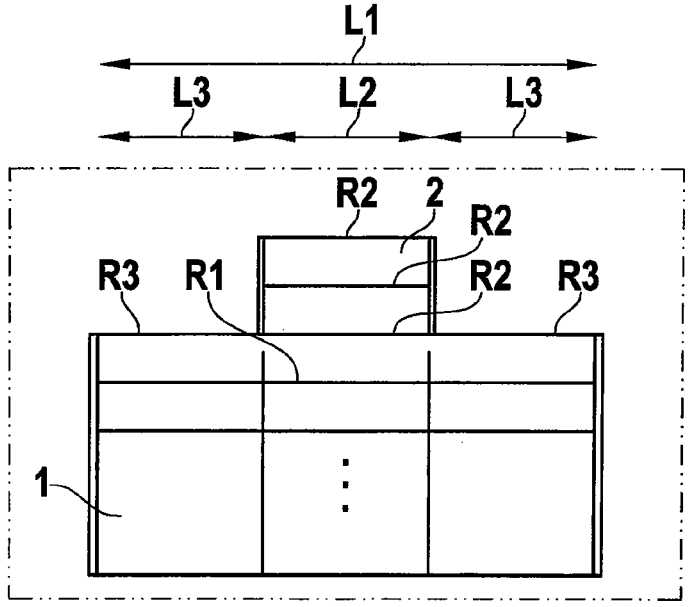
FIG. 2 shows the heating conductor structure for uniform heating.

The heating conductor structure of the windshield is preferably designed in such a way that the entire wiped area or at least an essential portion thereof may be heated. Uniform heating of the upper portion (segment 2) may be implemented according to FIG. 2 as follows: The heating conductors are characterized by their resistance. A horizontal heating conductor of length L1 has an ohmic resistance R1 over the entire windshield area. Based on an approximate division of the heating field into three parts by the vertical conductors (L2=L3=⅓*L1), the parallel circuit of the three horizontal heating conductors of length L2 shown in the central area in combination with the series circuit of the two resistors R3 must again an ohmic resistance R1 for uniform defrosting of the windshield. A standard value of 0.5 mm is assumed for the conductor width of conductor L1. In addition, it is required that the conductor path width of conductors L2 and L3 (R2=R3) be the same. For this case a resistance of $$RGES=R3+\tfrac{1}{3}*R2+R3,\ \text{i.e.,}\ RGES=R3+\tfrac{1}{3}*R3+R3=\tfrac{7}{3}*R3$$

results as the resistance of the uppermost heating connection. This resistance must be equal to resistance R1:

$$R1=\tfrac{7}{3}*R3.$$

The conductor path width of conductors L2 and L3 must therefore be less than that of conductors L1 by a factor of ⅔, i.e., in this example, approximately 0.2 mm.

The vertical conductor segments have a greater width in order to ensure the current distribution to conductors L2. The heating conductor structure having a nominal width of 0.5 mm is usually applied to the windshield by the silk-screen printing method, so that a continuous pressure of conductors L2 and L3 (having a width of 0.2 mm in this case) is ensured also with regard to manufacturing tolerances of the screen.

Of course, the dimensioning of the conductor path width is mentioned here as an example only. The exact dimensioning must be established in conjunction with the windshield pane size, the windshield wiping area, and the manufacturing tolerances of the silk-screen process.

The conductor structure is applied to the windshield pane by known processes; it is irrelevant from the point of view hereof whether the windshield is a safety glass pane or a composite safety glass. The windshield is surrounded by a metallic frame and is usually designed as a rear window of a motor vehicle.

Figure 3:
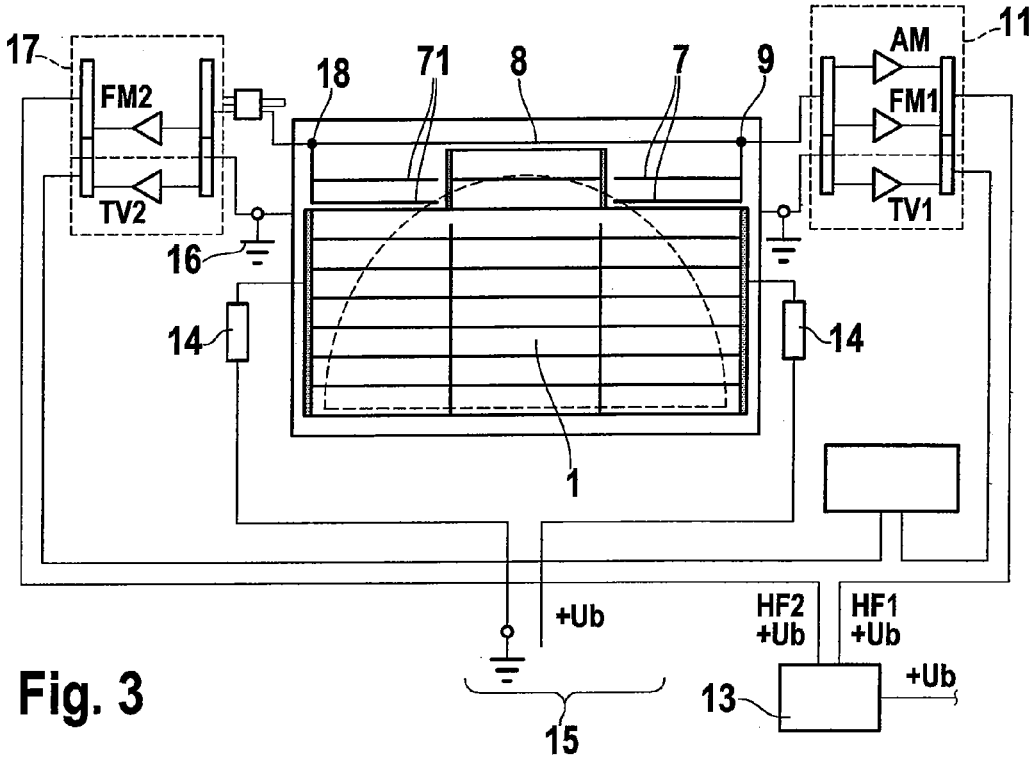
FIG. 3 shows a multiband antenna system having two antenna connecting points.

FIG. 3 shows another exemplary embodiment in which a second antenna structure 71 having a plurality of antenna conductors is formed on the opposite left-hand side and has an antenna connecting point 18 and, next to it, a ground connection 16. Optionally, TV reception is also implemented via connected electronic module 17. A dual antenna system is thus formed to ensure diverse radio and TV reception. Second antenna structure 71 is also capacitively coupled to heating conductor field 1 for UHF and/or TV reception in particular.

Figure 4:
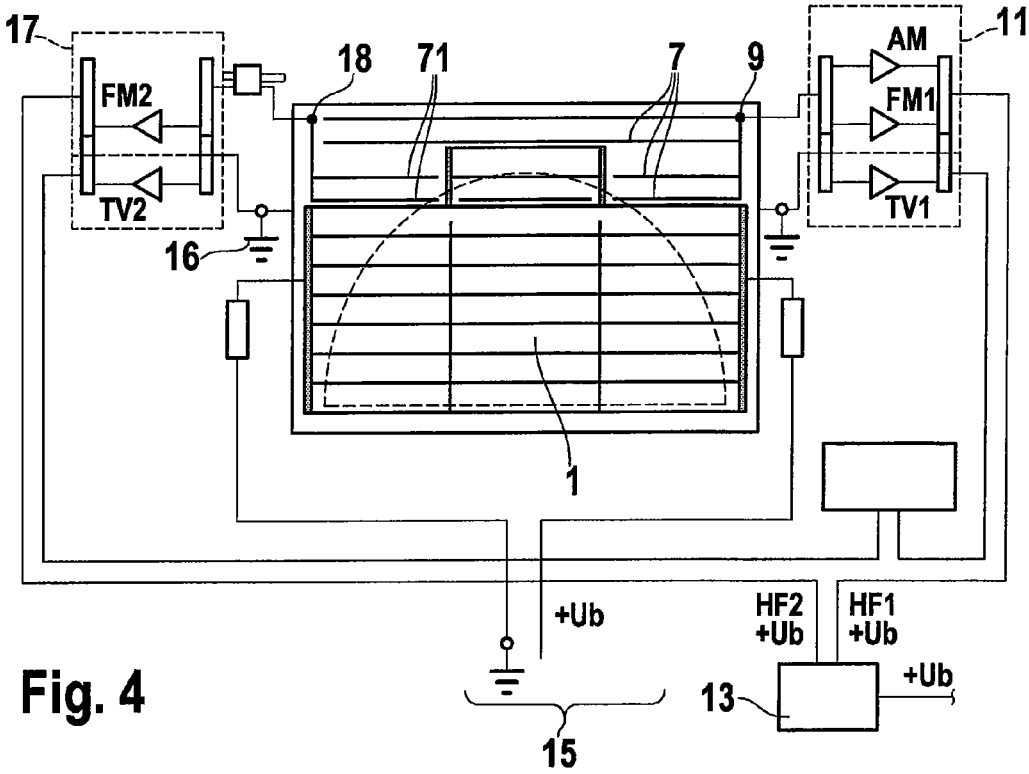
FIG. 4 shows a multiband antenna system having two antenna conductor structures which are electrically isolated from each other.

FIG. 4 shows a third exemplary embodiment in which the second UHF antenna is formed by a conductor structure 71 which is not electrically connected to conductor structure 7 of the first antenna. Another advantage of example embodiments of the present invention at this point is: In LMS reception the capacitance of the antenna conductor with respect to the vehicle mass is decisive. In conventional systems, the total capacitance of the system with respect to antenna connecting point 9 is increased in the dual-antenna system by connecting a second electronic module having a certain input capacitance. In other words, part of the received LMS signal is removed to ground via the second module, which causes the overall reception to deteriorate. This phenomenon is avoided in an antenna system according to example embodiments of the present invention having separate antenna structures according to FIG. 4.

Figure 5:
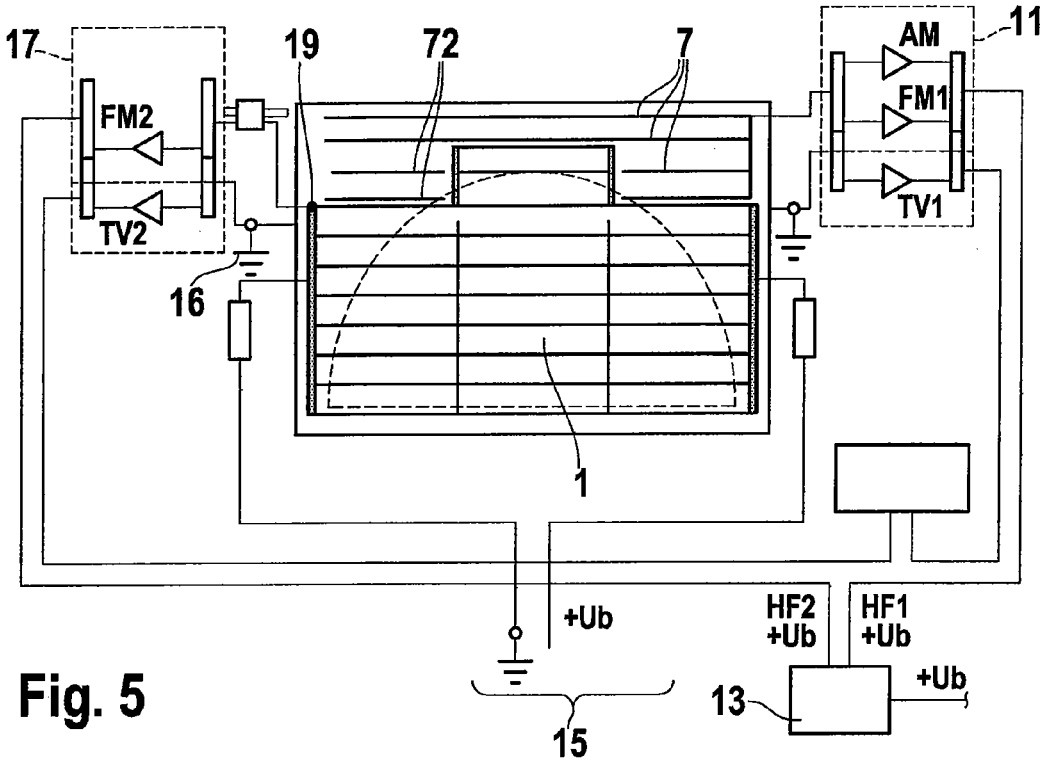
FIG. 5 shows a multiband antenna system whose second antenna conductor structure is substantially formed by the heating conductor field.

FIG. 5 shows an example embodiment in which the second UHF antenna structure results from the electrical contact 19 of heating conductor field 1 and an adjacent ground connection 16. The second antenna structure is therefore essentially formed by the heating conductor field in this case. Further antennas may also be formed from the heating conductor field in the same manner at another point, e.g., two additional antennas to form a four-antenna system, in particular for diversity reception. Conductors 72 are provided either for design reasons—symmetric appearance—or are coupled capacitively to conductors 7 for improving resonance and/or increasing the antenna gain.

Figure 6:
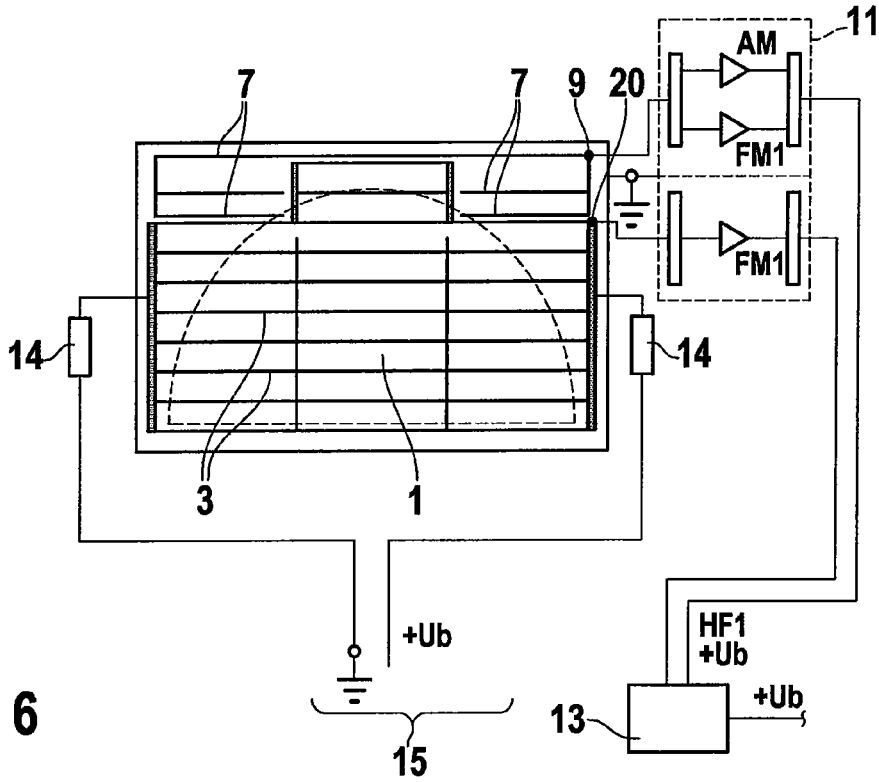
FIG. 6 shows a multiband antenna system having FM diversity.

In FIG. 6 a second FM amplifier is inserted into the same mechanical component 11. The second FM antenna is formed by electrical contact 20 of heating field 1, while the first FM antenna for component 11 has conductor structure 7 and contact 9. Both outputs of component 11 may be either directly connected to radio 13 having FM diversity or, alternatively, to a separate diversity box. Of course, the diversity logic may also be integrated into component 11.

What is claimed is:

1. A multiband antenna system for a window pane, comprising:

a heating conductor field having lateral recesses;

an antenna conductor structure for at least two reception ranges outside the heating conductor field, wherein the antenna conductor structure is situated substantially in the lateral recesses of the heating conductor field; and a coupling of the antenna conductor structure to the heating conductor field, wherein the coupling is effective for one of the at least two reception regions, wherein the coupling has a low-resistance at high-frequencies, and wherein the coupling is not galvanic;

wherein the heating conductor field is made up of at least two connected segments, including a first segment and a second segment, that are disposed such that the heating conductor field essentially covers an entire wiper region of the window pane, and wherein a circuit trace width of the heating conductors of the second segment of the at least two connected segments is smaller than a circuit trace width of heating conductors of the first segment of the at least two connected segments, so as to provide an essentially uniform defrosting of the window pane.

2. The antenna system according to claim 1, wherein the lateral recesses are at least one of (a) on and (b) in a window pane.

3. The antenna system according to claim 1, wherein the first segment fills the entire width of the window pane, and wherein the second segment extends only in a partial area of a width of the window pane, which is swept over by a free end of a window pane wiper.

4. The antenna system according to claim 3, wherein the antenna conductor structure for the at least two reception ranges is substantially provided in the lateral recesses of a width of the window pane which is not filled by the second segment.

5. The antenna system according to claim 1, wherein the antenna conductor structure is arranged to have a resonant response in a UHF reception range.

6. The antenna system according to claim 1, wherein an effective conductor length of the antenna conductor structure is selected such that a sufficient reception performance in an AM range is ensured.

7. The antenna system according to claim 1, wherein the antenna conductor structure has individual conductors connected in parallel which are combined at least one point to form an antenna connecting point, one of the individual conductors being capacitively coupled to the at least one heating conductor of the heating conductor field such that an entire heating conductor field is available as an effective antenna surface for one reception range.

8. The antenna system according to claim 7, wherein the one reception range includes the UHF range.

9. The antenna system according to claim 1, wherein at least one further antenna conductor structure is provided for at least one of (a) another reception range and (b) a diversity operation for a reception range.

10. The antenna system according to claim 9, wherein the further antenna conductor structure is situated opposite the antenna conductor structure isolated by the second segment.

11. The antenna system according to claim 9, wherein the further antenna conductor structure is connected to the antenna conductor structure via at least one conductor extending over an free end of the second segment.

12. The antenna system according to claim 9, wherein the further antenna structure is electrically decoupled from the antenna structure.

13. The antenna system according to claim 9, wherein the further antenna conductor structure is substantially formed by the heating conductor field.

14. The antenna system according to claim 1, wherein at least one further antenna conductor structure is provided for another reception range.

15. The antenna system according to claim 1, wherein at least one further antenna conductor structure is provided for a diversity operation for a reception range.

* * * * *

UNITED STATES PATENT AND TRADEMARK OFFICE

CERTIFICATE OF CORRECTION

PATENT NO. : 7,880,679 B2
APPLICATION NO. : 12/064771
DATED : February 1, 2011
INVENTOR(S) : Rainer Kuehne It is certified that error appears in the above-identified patent and that said Letters Patent is hereby corrected as shown below:

Title Page, Item (73) Assignee; please change assignee "Robert Bosch GmbH", to --Blaupunkt Antenna Systems GmbH & Co. KG--.

Signed and Sealed this
Thirty-first Day of May, 2011

David J. Kappos

David J. Kappos
*Director of the United States Patent and Trademark Office*